US010851948B2

(12) United States Patent
Burmeister et al.

(10) Patent No.: US 10,851,948 B2
(45) Date of Patent: Dec. 1, 2020

(54) LED MODULE, LUMINAIRE COMPRISING SAME AND METHOD FOR INFLUENCING A LIGHT SPECTRUM

(71) Applicant: Eaton Protection Systems IP GmbH & Co. KG, Schönefeld (DE)

(72) Inventors: Jens Burmeister, Eberbach (DE); Lisa Morr, Hirschhorn (DE)

(73) Assignee: Eaton Protection Systems IP GmbH & Co. KG, Schönefeld (DE)

( * ) Notice: Subject to any disclaimer, the term of this patent is extended or adjusted under 35 U.S.C. 154(b) by 0 days.

(21) Appl. No.: 16/107,062

(22) Filed: Aug. 21, 2018

(65) Prior Publication Data

US 2018/0356047 A1 Dec. 13, 2018

Related U.S. Application Data

(63) Continuation of application No. 14/782,283, filed as application No. PCT/EP2014/000882 on Apr. 2, 2014, now abandoned.

(30) Foreign Application Priority Data

Apr. 5, 2013 (DE) ..... 10 2013 005 932

(51) Int. Cl.
*F21K 9/60* (2016.01)
*F21K 9/20* (2016.01)
(Continued)

(52) U.S. Cl.
CPC ..... *F21K 9/20* (2016.08); *F21V 7/0008* (2013.01); *F21V 19/001* (2013.01); *F21V 19/04* (2013.01);
(Continued)

(58) Field of Classification Search
CPC ..... F21K 9/23; F21K 9/30
(Continued)

(56) References Cited

U.S. PATENT DOCUMENTS 7,255,457 B2 * 8/2007 Ducharme ..... H05B 33/0857 362/231
8,616,728 B2 * 12/2013 Odnoblyudov ..... F21K 9/00 362/231
(Continued)

FOREIGN PATENT DOCUMENTS

CN 101255956 9/2008
CN 101449097 6/2009
(Continued)

OTHER PUBLICATIONS

Kebemou, Augustin, International Search Report of International Application No. PCT/EP2014/000882, completed Jun. 5, 2014, dated Jun. 16, 2014, 6 pages, European Patent Office.
(Continued)

*Primary Examiner* — Evan P Dzierzynski
*Assistant Examiner* — Keith G. Delahoussaye
(74) *Attorney, Agent, or Firm* — Pearne & Gordon LLP

(57) ABSTRACT

The invention relates to an LED module (1) for a luminaire (2) comprising at least one LED carrier (3) and a plurality of LEDs (4) (light-emitting diodes) arranged on this LED carrier. In particular, the number and the color of the LEDs (4) are selected to emit a total light emission spectrum (6) being composed of individual light emission spectra (5) of each LED. The invention further relates to a luminaire (2) comprising a luminaire housing (10), at least one LED module (1) arranged as light source (13) in the luminaire housing (10), a light emergence opening (11) formed in the luminaire housing (10), and a glare-limiting device (12) assigned in particular to the light emergence opening (11), as
(Continued)

well as to a method for influencing a light spectrum of a light source (13).

17 Claims, 3 Drawing Sheets

(51) Int. Cl.

| | |
|---|---|
| ***F21V 7/00*** | (2006.01) |
| *F21Y 105/10* | (2016.01) |
| *F21Y 103/10* | (2016.01) |
| *F21Y 115/10* | (2016.01) |
| *F21Y 113/13* | (2016.01) |
| *F21W 131/10* | (2006.01) |
| *F21W 131/103* | (2006.01) |
| *F21V 19/04* | (2006.01) |
| *F21V 19/00* | (2006.01) |

(52) U.S. Cl.
CPC ... *F21W 2131/10* (2013.01); *F21W 2131/103* (2013.01); *F21Y 2103/10* (2016.08); *F21Y 2105/10* (2016.08); *F21Y 2113/13* (2016.08); *F21Y 2115/10* (2016.08)

(58) Field of Classification Search
USPC ..... 362/231
See application file for complete search history.

(56) References Cited

U.S. PATENT DOCUMENTS

| | | | | |
|---|---|---|---|---|
| 8,716,953 | B2 * | 5/2014 | Kreiner | H05B 33/0842 315/297 |
| 2005/0168982 | A1 | 8/2005 | Miller et al. | |
| 2007/0247414 | A1 * | 10/2007 | Roberts | F21K 9/00 345/102 |
| 2008/0092800 | A1 * | 4/2008 | Smith | H05B 33/0842 116/202 |
| 2009/0121641 | A1 * | 5/2009 | Shih | G01J 1/1626 315/157 |
| 2009/0224693 | A1 * | 9/2009 | Mukai | H05B 45/40 315/295 |
| 2009/0290339 | A1 * | 11/2009 | Chang | G02F 1/133603 362/231 |
| 2009/0323321 | A1 * | 12/2009 | Paolini | H05B 33/086 362/231 |
| 2009/0323334 | A1 | 12/2009 | Roberts et al. | |
| 2010/0020536 | A1 | 1/2010 | Bafetti et al. | |
| 2010/0296279 | A1 | 11/2010 | Ko | |
| 2011/0157492 | A1 | 6/2011 | Shin et al. | |
| 2012/0162979 | A1 * | 6/2012 | Ng | H01L 25/0753 362/231 |
| 2013/0169187 | A1 | 7/2013 | Lai | |
| 2013/0194792 | A1 * | 8/2013 | Van De Ven | F21K 9/00 362/231 |
| 2013/0265752 | A1 * | 10/2013 | Shimizu | F21V 5/045 362/231 |
| 2014/0191686 | A1 * | 7/2014 | Maxik | F21S 8/022 315/307 |
| 2014/0218917 | A1 * | 8/2014 | Baran | F21S 8/00 362/235 |
| 2014/0268734 | A1 * | 9/2014 | Chang | H05B 33/0821 362/231 |
| 2014/0328052 | A1 | 11/2014 | Hochman et al. | |
| 2014/0346954 | A1 * | 11/2014 | Li | H05B 33/0809 315/121 |
| 2015/0109774 | A1 | 4/2015 | Deregibus | |

FOREIGN PATENT DOCUMENTS

| | | |
|---|---|---|
| CN | 101806430 | 8/2010 |
| CN | 202110308 U | 1/2012 |
| DE | 102004006005 | 7/2005 |
| DE | 102005061204 | 7/2007 |
| DE | 102007026867 | 10/2008 |
| EP | 1951004 | 7/2008 |
| TW | 201019501 | 5/2010 |
| WO | WO 2007/075815 | 7/2007 |

OTHER PUBLICATIONS

Mei-Hua, Wang, Office Action issued in Taiwanese Application No. 103108512, dated Nov. 23, 2015, 6 pages 5 pages, Taiwanese Intellectual Property Office.
Translation of Taiwanese Office Action 3 pages.
Machine translation of CN202110308U, via Lexis Nexis Total Patent, 5 pages.
Translation of Chinese Office Action issued in Chinese Application No. 201480019957.9, dated May 16, 2016, 8 pages, The State Intellectual Property Office of the People's Republic of China.
Machine translation of CN 101449097, via LexisNexis Total Patent, 28 pages.
Chinese Office Action issued in Chinese Application No. 201480019957.9, dated Nov. 17, 2016, 6 pages, The State Intellectual Property Office of the People's Republic of China, with an English translation attached 8 pages.
Machine translation of CN101255956, via LexisNexsis Total Patents, 6 pages.
Machine translation of CN101806430, via LexisNexsis Total Patents, 8 pages.
Chinese Office Action issued in Chinese Application No. 201480019957.9, dated Apr. 25, 2017, 19 pages, The State Intellectual Property Office of the People's Republic of China (translation included).
Taiwanese Office Action issued in Taiwanese Application No. 10620534610, dated May 19, 2017, 3 pages, Taiwanese Patent Office.
Machine Translation of TW 201019501 via Total Patent Lexsis Nexis, Sep. 19, 2017, 16 pages.

* cited by examiner

LED MODULE, LUMINAIRE COMPRISING SAME AND METHOD FOR INFLUENCING A LIGHT SPECTRUM

PRIORITY CLAIM

The present application is a continuation application of and claims priority under 35 U.S.C. § 120 to U.S. patent application Ser. No. 14/782,283, titled "LED Module, Luminaire Comprising Same and Method For Influencing a Light Spectrum" and filed on Oct. 2, 2015, which is a national phase of and claims priority to International Application No. PCT/EP2014/000882 with an International filing date of Apr. 2, 2014 and which claims priority to German patent application no. 10 2013 005 932.1 filed Apr. 5, 2013. The foregoing applications are hereby incorporated herein by reference.

TECHNICAL FIELD

The invention relates to an LED module, a luminaire comprising such an LED module, and a method for influencing a light spectrum.

BACKGROUND

A light spectrum, or also a color spectrum, is a part of the electromagnetic spectrum that can be perceived by the human eye without any technical aids. Such a light spectrum is composed of emitted or reflected spectral colors of one respective light source or of light sources. As a rule, such a light source emits light with a specific frequency spectrum or corresponding spectral distribution. The corresponding frequencies of the light determine the color thereof. Corresponding artificial light sources differ in color, brightness etc. A visible portion of the light spectrum has a wavelength in the range of approximately 380 to 780 nm, respectively frequencies in the range of approximately 3.8×10" to 7.9×10" Hz. Corresponding color components of the light spectrum are not distinguishable without optical aids. As a rule, many light sources emit a light spectrum that is a combination of different individual colors which, in the eye of a viewer, result in an overall color impression, respectively in a mixed color. Such a light color corresponds to a color impression of the light which directly stems from a corresponding luminous light source. The light color depends, in this case, on the spectral composition of this radiation.

With regard to the light color even a light being "white" per se can be subdivided, e.g. into warm white, neutral white, daylight white etc. Each of these corresponding shades of white has different effects on human beings. Corresponding psychological effects on the viewer are also discussed in connection with other light colors. In connection with other species it should furthermore be kept in mind that these normally have different sensitivities for specific spectral ranges as compared with human beings.

In connection with the light color yet another parameter should be considered, which is designated as the color rendering index.

This index is a photometric quantity by means of which the quality of the color rendering of light sources of the same correlated color temperature can be described. For instance, up to a color temperature of 5000 K, the light emitted by a black body of a corresponding color temperature serves as a reference for the evaluation of the rendering quality. The color rendering index is "100" if a corresponding artificial light source perfectly reproduces the spectrum of a black body with the same color temperature in the range of the visible wavelengths.

One example for light sources frequently used in the recent past are LED light sources which consume little energy and, at the same time, have a long lifespan. Corresponding LEDs normally generate a substantially monochromatic radiation. The shade of the corresponding LED light is dominated by the dominant wavelength of the corresponding radiation. LEDs are available in different colors, such as red, orange, yellow, green or blue. Also, white LEDs are known, which usually make use of a conversion layer in order to convert the LED-generated, actually blue light into white light. Such conversion layers are also known from fluorescent lamps.

A corresponding emission spectrum of an LED is relatively narrow-band, wherein—see the above statements—a corresponding dominant wavelength, and thus the color of the light depend on the materials used for the manufacture of a corresponding semiconductor crystal of the LED. Usually, LED light does not contain UV or IR radiation.

LEDs are preferably manufactured as LED modules. These modules are very flat and have a plurality of LEDs on one carrier. Such a carrier may also be flexible. The carrier may be a printed circuit board on which a corresponding wiring and/or electronic components are mounted for operating the LEDs.

In the DE 10 2010 033 141 document a luminaire is described, where the generated light is influenced with respect to spectral sensitivities of different species. The light source of such a luminaire is, for instance, an LED module, or a plurality thereof, as described above. In order to influence the corresponding light a filter device is used, which filters out one or more specific spectral ranges of the emitted light at least in part.

Thus, spectral ranges are filtered out, or at least reduced, in which specific species, and in particular animals, have a greater sensitivity, and in which spectral ranges these species may be exposed to a negative influence. It is, of course, also conceivable that the spectral range of the light to be emitted is chosen to have a positive influence on one or more species. The corresponding luminaire may be used, for instance, as streetlight or for the illumination of sidewalks or parks, or the like.

Of course, it is also possible to realize a corresponding light filtering in rooms in which specific spectral ranges of the emitted light could trigger reactions or the like. See, for instance, biological, chemical or also physical applications.

According to the DE 10 2010 033 141 document a corresponding filter device is arranged in the luminaire housing or in the region of a light emergence opening of the luminaire housing. This means that influencing the corresponding light spectrum or color spectrum of the light source is achieved by an additional device. The drawback of such a device is that a portion of the light is retained, so that the effectiveness of the overall illumination system is reduced. In other words, filtering leads to a reduction of the radiation capacity or radiant intensity as compared to a luminaire without filtering with the same power supply.

SUMMARY

Therefore, the invention is based on the object to allow influencing the light spectrum or color spectrum in an easy manner without reducing the radiation capacity or radiation intensity, without having to perform large-scale physical alterations or provide for additional installations in a corresponding luminaire.

According to the invention the object is achieved by the features of patent claim 1. This applies analogously to the features of the method claim, and to a corresponding luminaire having such an LED module.

According to the invention the LED module is characterized in that the number and color of the LEDs are selectable to emit a total light emission spectrum being composed of the individual light emission spectra of each LED. This means that, for instance, two red LEDs, three green LEDs, four blue LEDs and two yellow LEDs are operated together so as to form one total light emission spectrum with the desired pattern from the corresponding individual light emission spectra.

The corresponding luminaire comprises at least one LED module, wherein also several of those modules are usable. Moreover, such a luminaire comprises at least one luminaire housing, a light emergence opening formed in the luminaire housing, and a glare-limiting device. This glare-limiting device limits the emergence of light from the light emergence opening of the luminaire to a specific range, for instance, for reducing a glare of the luminaire.

According to the method the corresponding light color of the light emitted by the luminaire is influenced in such a manner that a plurality of LEDs are arranged on a corresponding LED module at least in one row and/or column. Each of the LEDs emits light according to an individual light emission spectrum, wherein the individual spectra of all LEDs are superimposed to one total light emission spectrum, resulting in the light spectrum of the light source of the corresponding luminaire.

It is possible that each LED is configured to emit a substantially monochromatic light radiation. The corresponding individual light emission spectrum of each LED is known per se, or can at least be determined in advance. LEDs having a different monochromatic light radiation are then arranged together on the corresponding LED carrier, and by the superposition of the individual light emission spectra to one total light emission spectrum the correspondingly desired light spectrum of the light source is obtained.

It is possible that LEDs having the same monochromatic light radiation are respectively arranged on a sub-module of the LED module. This means that LEDs having the same monochromatic light radiation are each arranged together, and sub-modules with those LEDs are combined depending on the required number of the corresponding LEDs. In this case, the LEDs are arranged relatively closely to one another, so that already a small distance is enough, and with the aid of corresponding reflection devices, if necessary, that point light sources are no longer discernible, but only the superposition of all individual light emission spectra to the total light emission spectrum can still be recognized by a viewer.

By using sub-modules it is possible in a simple way to combine LEDs with a corresponding light color according to need, and choose a respective number. If, for instance, more yellow LEDs are required, more sub-modules with those yellow LEDs are added. This applies analogously to LEDs with different colors.

It is also possible, however, that LEDs having a different monochromatic light radiation are arranged on a sub-module of the LED module. This means that a desired light color is already provided on a sub-module by combining differently colored LEDs on this sub-module. A number of such sub-modules can then be used together as an LED module, and these then bring about the desired total light emission spectrum.

The LED arrangement is such that the LEDs are arranged on the corresponding LED carrier along at least one row and/or column. As was already stated above, such a carrier may be a corresponding printed circuit board for supplying the LEDs, for the corresponding wiring for necessary connections, and also for the arrangement of other electronic or electrical devices.

With a row and/or column arrangement of this type it is possible that, for instance, only same-colored LEDs are arranged along one row or, correspondingly, that those LEDs are arranged along one column. Also, it is conceivable that different-colored LEDs are provided in each row and/or column.

According to the invention it is particularly advantageous in this connection if the LEDs can all be triggered together, i.e. are supplied with a same voltage, respectively current intensity. Thus, the controlling as a whole is simplified, and with the identical supply of all LEDs the correspondingly emitted individual light emission spectrum is well reproducible and the total light emission spectrum is reliably producible by adding up all individual light emission spectra.

In order to increase, if necessary, the color rendering index of the corresponding light source white LEDs may be assigned to the monochromatic LEDs. The number of the white LEDs can be determined, for instance, in that the color rendering index is to reach a value of 100 or at least close to 100.

In order to be able to change the total light emission spectrum in an easy manner, if necessary, it is conceivable that modules and/or sub-modules are arranged in the luminaire to be exchangeable. This may analogously be applied to the corresponding LED carrier.

In order to change the light color of the light source for a short time, if necessary, it may furthermore prove to be advantageous if the sub-modules can be triggered individually. This means that, for instance, a sub-module with only yellow LEDs is switched on only if the total light emission spectrum is to be changed correspondingly by switching on these yellow LEDs. This applies analogously to different-colored LEDs, white LEDs and the like.

As was already stated above, such an adjustment of the total light emission spectrum can be made particularly with respect to specific species that have a greater sensitivity in a spectral range. Also, it is conceivable that the adjustment of the total light emission spectrum is made with respect to more than one species, if these have the same sensitivity in a specific spectral range or at least in closely adjacent spectral ranges. According to the invention it is also possible to intensify a specific spectral range with respect to light emission by switching on LEDs, if the LEDs to be switched on irradiate, for instance, in this spectral range. Thus, certain advantageous effects in the specific spectral range may be enhanced.

It is likewise possible that the light spectrum is not only changed by switching on corresponding LEDs, but also by the selective deactivation of specific LEDs having a known individual light emission spectrum. Such a deactivation of LEDs, too, results in a change of the total light emission spectrum which may have the desired effect.

BRIEF DESCRIPTION OF THE DRAWINGS

Advantageous embodiments will be described in more detail below by means of the figures depicted in the drawing. In the drawing.

DETAILED DESCRIPTION OF EXAMPLE EMBODIMENTS

Figure 1:
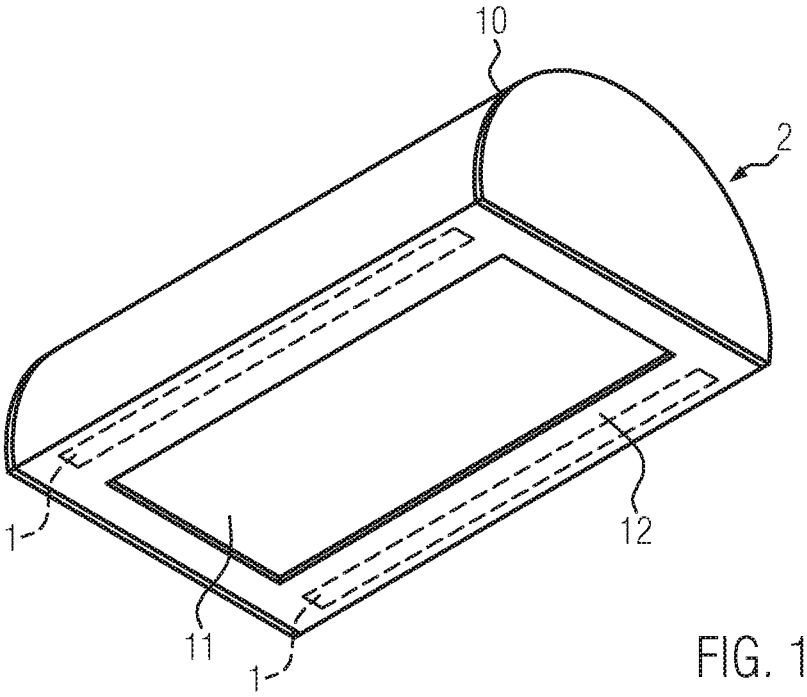
FIG. 1 shows a perspective bottom view of a luminaire having LED modules.

FIG. 1 shows a perspective diagonal bottom view of a luminaire 2 comprising an LED module 1 according to the invention. In the illustrated embodiment corresponding LED modules 1 are arranged as light source 13 on both sides of a light emergence opening 11 in a luminaire housing 10. The LED modules 1 can both be triggered at the same time and supplied with the same voltage, respectively current intensity. The luminaire 2 as illustrated is only an example and shown in a simplified manner, and may be used, for instance, for the illumination of paths, roads and the like. In order to prevent, or at least reduce a possibly existing glare of the corresponding lamp inside the luminaire 2 a glare-limiting device 12 may be assigned to the light emergence opening 11, which reduces, for instance, the light emergence opening 11 in the direction of the surface to be irradiated and, if necessary, limits light additionally emitted by the light source only to a certain area for the illumination thereof.

Different embodiments for a corresponding LED module 1 are conceivable. Two embodiments are shown in FIGS. 2 and 3.

Figure 2:
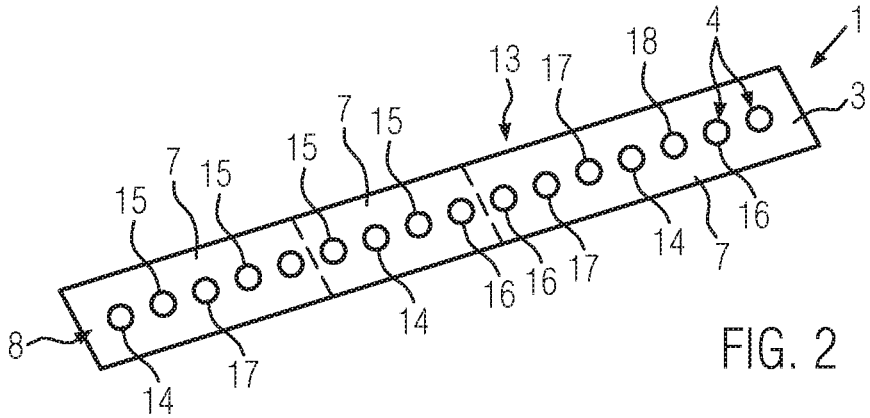
FIG. 2 shows an enlarged representation of an exemplary embodiment of an LED module.
Figure 3:
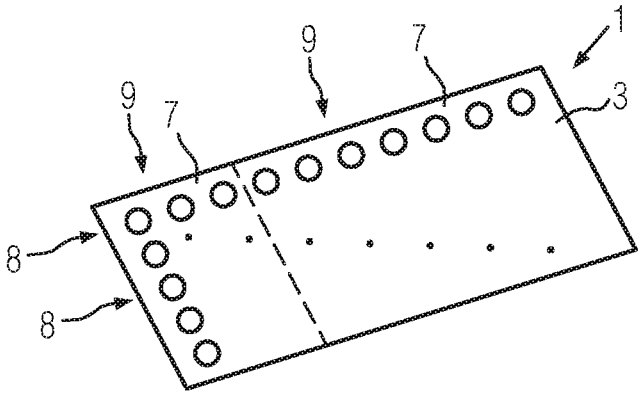
FIG. 3 shows an enlarged representation of another exemplary embodiment of an LED module.

In the embodiment according to FIG. 2 corresponding LEDs 4 are arranged along a row 8. The LEDs 4 are all arranged on an LED carrier 3 which is configured, for instance, as a printed circuit board. The LED carrier 3 with the LEDs 4 of FIG. 2, or also of FIG. 3, forms a corresponding LED module 1. It is once more pointed out that, for instance, the arrangement and number of the LEDs 4 on the corresponding LED carrier 3 are only exemplary, and are shown with a small number of LEDs 4. It is also possible to use more LED carriers 3, respectively LED modules 1 in the luminaire 2 according to FIG. 1.

The different LEDs 4 on the carrier 3 are different-colored LEDs and have, depending on the color, another individual light emission spectrum. See also FIGS. 4 and 6. LEDs are substantially monochromatic light sources, i.e. they emit light only in a narrow-band, respectively limited spectral range. By deliberately choosing the corresponding semiconductor materials and the doping thereof it is possible to vary the properties of the light generated by LEDs. Nowadays, LEDs having red, orange, yellow, green, blue and violet colors are available. Radiation by LEDs can also be produced beyond this visible range of the light spectrum. See, for instance, the near-infrared range up to a wavelength of 1000 nm or also the ultraviolet range.

For generating white light by a light-emitting diode, for instance, a blue or UV LED is used, with additional photoluminescent material. Similar to fluorescent tubes this material converts the short-wave and higher energetic light into longer-wave light.

A corresponding number of individual LEDs 4 of different colors are arranged on the LED module 1, respectively LED carrier 3. See, for instance, green LEDs 14, yellow LEDs 15, orange LEDs 16, red LEDs 17 or white LEDs 18.

It is noted once more that the arrangement and number of the LEDs are only exemplary.

This applies analogously to FIG. 3, in which the corresponding LEDs 4 are arranged both in rows and columns. In the embodiment shown five rows and ten columns of LEDs are provided on the corresponding LED carrier 3, respectively LED module 1.

In this module according to FIG. 3, too, different-colored LEDs can be arranged both along a row and a column.

Also, it is possible that a corresponding LED module 1, respectively LED carrier 3, is composed of sub-modules 7. These may have, for instance, a respectively predefined number of different-colored LEDs, or also be provided with only monochromatic LEDs. This applies analogously to the embodiment of FIG. 3.

According to the invention it has proved to be advantageous that all LEDs 4 on the corresponding carrier, respectively corresponding module, are triggered in the same manner and at the same time, i.e. are supplied with the same voltage, respectively same current. By this, the light emission of each LED is predetermined with respect to its individual light emission spectrum, and well known, without great effort, so that the different individual light emission spectra can be superimposed to one total light emission spectrum. See the statements set forth below.

It is also possible, however, that at least the sub-modules are triggered separately. This is particularly favorable if each sub-module is occupied, for instance, by LEDs of only one color. This means that, for instance, all yellow LEDs arranged on a specific sub-module 7 could be switched off or switched on. Thus, a corresponding individual light emission spectrum for the light color "yellow" would be missing in the total light emission spectrum. Moreover, it is possible to provide several sub-modules each with same-colored LEDs so that, for instance, one sub-module with yellow LEDs, two of those sub-modules, or also more of them can be switched on/off. This applies analogously to different-colored LEDs.

The above statements also apply if different-colored LEDs are provided on each sub-module, so that, depending on the case of need, fewer or more of such sub-modules are arranged together in a luminaire, or are triggered in a luminaire, to obtain the corresponding illumination.

Figure 4:
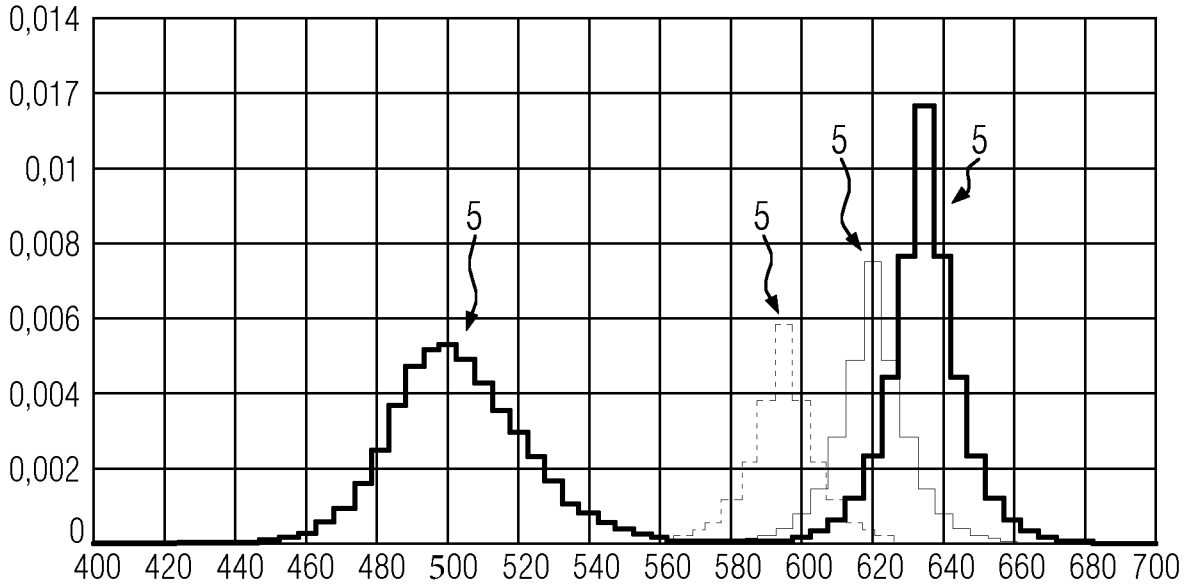
FIG. 4 shows individual light emission spectra for different-colored LEDs.
Figure 5:
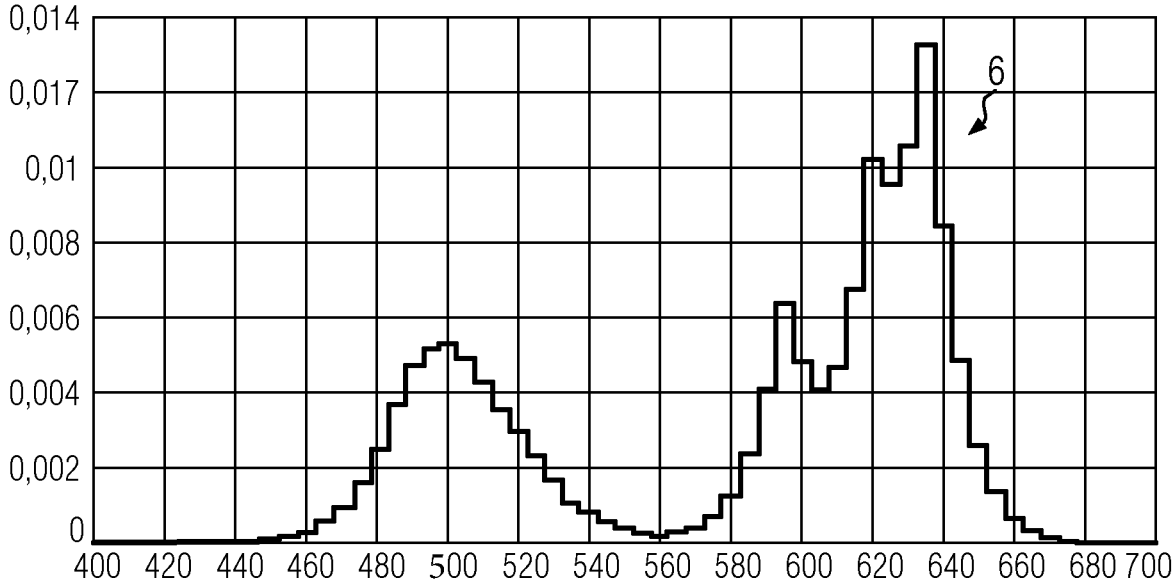
FIG. 5 shows a total light emission spectrum formed of the individual light emission spectra represented in FIG. 4.

FIG. 4 illustrates an embodiment for an LED module 1 having a number of individual light emission spectra 5. FIG. 4 firstly shows from left to right an individual light emission spectrum for the color green, for the color yellow, for the color orange, and for the color red. The intensities of the corresponding spectra are indicated in nm, depending on the wavelength. For instance, one green, one red, one orange and three yellow LEDs produce the corresponding individual light emission spectra 5. If one is positioned sufficiently apart from the corresponding light source 13, respectively luminaire 2, the individual light emission spectra are superimposed to one total light emission spectrum 6. See FIG. 5 in which no LEDs 4, see FIG. 2, respectively 3, are discernible any longer as individual light sources. That is, FIG. 5 shows a mixture of four different LED types with different light colors which, moreover, are provided in different numbers. A corresponding total light emission spectrum 6 can already be composed of the individual light emission spectra known per se relatively well prior to setting up the lamp by a corresponding computer simulation or the like. That is, it is possible to realize a corresponding total light emission spectrum for predetermined illumination purposes in a corresponding luminaire in a targeted manner.

Figure 6:
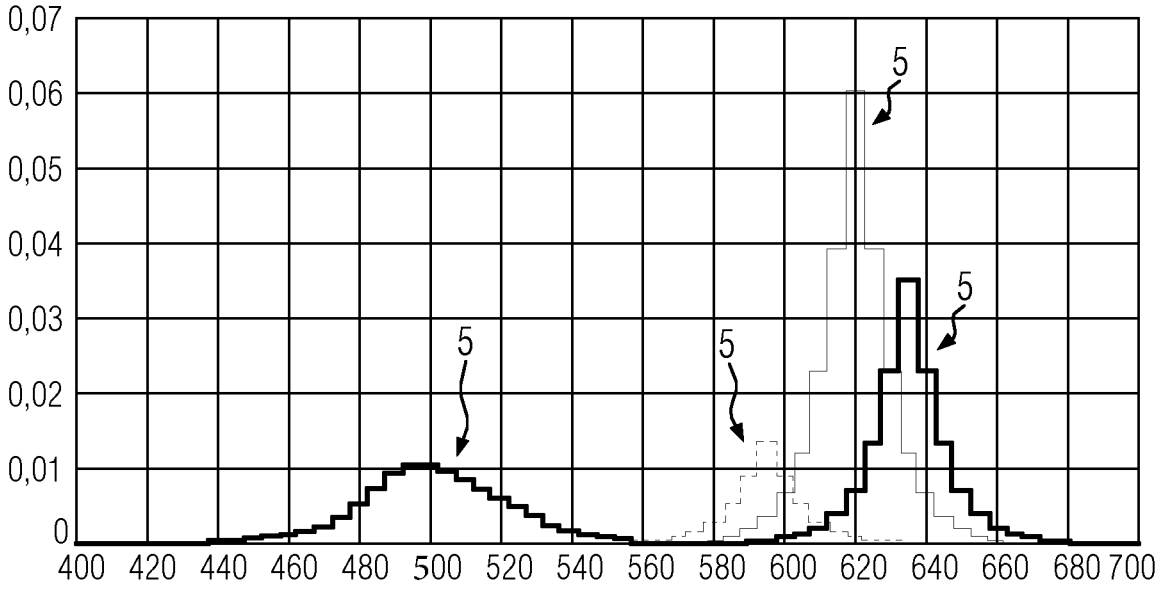
FIG. 6 shows another example analogously to FIG. 4.
Figure 7:
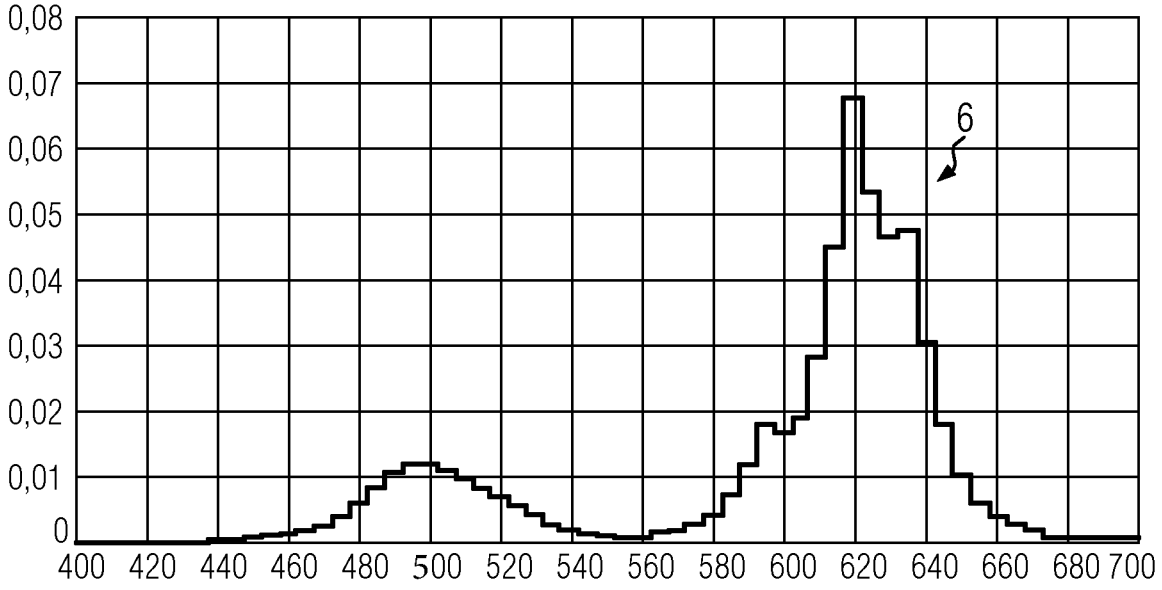
FIG. 7 shows a total light emission spectrum formed of individual light emission spectra of FIG. 6.

FIGS. 6 and 7 show another exemplary embodiment. Again, corresponding individual light emission spectra 5 for green, yellow, orange and red LEDs are shown from left to right in FIG. 6. In this case, three red, two green, eight orange and seven yellow LEDs are used, whose individual light emission spectra 5 being superimposed result in the total light emission spectrum according to FIG. 7 where, for instance, the relative portion of "green" is considerably reduced in comparison with FIG. 5.

This means, for a species reacting sensitively, for instance, in the green range a light source having a total light emission spectrum 6 according to FIG. 7 would be advantageous. Vice versa, a light source having a total light emission spectrum 6 according to FIG. 5 could be used if value is placed on an increased portion in the green range.

The other portions of the total light emission spectrum according to FIGS. 5 and 7 are nearly unchanged.

By correspondingly selecting the number and the color of the different LEDs of a sub-module 7, respectively the entire LED module 1, it is possible to realize yet other total light emission spectra 6, as desired and needed.

In connection with FIG. 2 a white LED 18 was emphasized which may be provided in addition to the colored LEDs, for instance, in order to increase the color rendering index. Of course, it is also possible in this connection to use more of those white LEDs.

What is claimed is:

1. A light-emitting diode ("LED") luminaire (2) comprising a plurality of LED modules that provide general illumination to a volume of space, wherein each LED module comprises at least one LED carrier (3) and a plurality of LEDs (4) arranged on the at least one LED carrier, wherein a first LED module of the plurality of LED modules has disposed thereon a first plurality of LEDs that emit a first substantially similar constant monochromatic radiation among a first range of first substantially similar constant monochromatic radiations of a first non-white color and at least one first white LED, wherein a second LED module of the plurality of LED modules has disposed thereon a second plurality of LEDs that emit a second substantially similar constant monochromatic radiation among a second range of second substantially similar constant monochromatic radiations of a second non-white color, wherein the first plurality of LEDs, the second plurality of LEDs, and the at least one first white LED emit a first total light emission spectrum (6) that is generated by overlapping the first substantially similar constant monochromatic radiation emitted by the first plurality of LEDs, a light emission emitted by the at least one first white LED, and the second substantially similar constant monochromatic radiation emitted by the second plurality of LEDs, wherein all of the first plurality of LEDs of the first LED module are controlled together, wherein all of the second plurality of LEDs of the second LED module are controlled together and independently of the first plurality of LEDs, wherein the first plurality of LEDs and the second plurality of LEDs are individually controlled simultaneously to emit the first total light emission spectrum, and wherein the at least one first white LED increases a color rendering index, wherein the first LED module is configured to allow a quantity of the first plurality of LEDs to be physically changed.

2. The luminaire according to claim 1, wherein the first total light emission spectrum comprises a ratio of light colors comprising light from three red LEDs, two green LEDs, eight orange LEDs, and seven yellow LEDs.

3. The luminaire according to claim 1, wherein the first plurality of LEDs can be arranged on the LED carrier (3) along at least one of a row (8) and a column (9).

4. The luminaire according to claim 1, wherein the second LED module is replaced by a third LED module, wherein the third LED module comprises a third plurality of LEDs that emit a third range of substantially similar constant monochromatic radiation.

5. The luminaire according to claim 1, wherein the first plurality of LEDs, the second plurality of LEDs, and the at least one first white LED emit a second total light emission when the first plurality of LEDs of the first LED module emits a third substantially similar constant monochromatic radiation within the first range of substantially similar constant monochromatic radiations while the second plurality of LEDs of the second LED module continues to emit the second substantially similar constant monochromatic radiation within the second range of substantially similar constant monochromatic radiations.

6. The luminaire according to claim 1, wherein the first plurality of LEDs, the second plurality of LEDs, and the at least one first white LED emit a second total light emission when the second plurality of LEDs of the second LED module emits a third substantially similar constant monochromatic radiation within the second range of substantially similar constant monochromatic radiations while the first plurality of LEDs of the first LED module continues to emit the first substantially similar constant monochromatic radiation within the first range of substantially similar constant monochromatic radiations.

7. The luminaire according to claim 1, wherein the plurality of LED modules further comprises a third LED module and a fourth LED module, wherein the third LED module has disposed thereon a third plurality of LEDs that emit a third range of substantially similar constant monochromatic radiations of a third non-white color, and wherein the fourth LED module has disposed thereon a fourth plurality of LEDs that emit a fourth range of substantially similar constant monochromatic radiations of a fourth non-white color.

8. The luminaire according to claim 7, wherein the first non-white color, the second non-white color, the third non-white color, and the fourth non-white color are selected from among a group consisting of red, green, orange, and yellow.

9. A luminaire comprising a luminaire housing and a light-emitting diode (LED) module (1) coupled to the luminaire housing, wherein the LED module provides general illumination to a volume of space, wherein the LED module comprises a plurality of sub-modules disposed on at least one LED carrier, wherein the plurality of sub-modules comprises a first sub-module and a second sub-module, wherein the first sub-module comprises a first plurality of LEDs and at least one white LED, wherein the second sub-module comprises a second plurality of LEDs, wherein the first plurality of LEDs emits a first range of substantially similar constant monochromatic radiations of a first non-white color, wherein the second plurality of LEDs emits a second range of substantially similar constant monochromatic radiations of a second non-white color, wherein the plurality of sub-modules emit a first total light emission spectrum comprising a first substantially similar constant monochromatic radiation within the first range of first substantially similar constant monochromatic radiations and a light emission of the at least one first white LED for the first sub-module and a second substantially similar constant monochromatic radiation within the second range of second substantially similar constant monochromatic radiations for the second sub-module, wherein the first plurality of LEDs of the first sub-module are controlled together, wherein the second plurality of LEDs of the second sub-module are controlled together and independently of the first plurality of LEDs, wherein the first sub-module and the second sub-module are controlled independently of each other, wherein the first sub-module and the second sub-module are individually controlled simultaneously to emit the first total light emission spectrum, wherein at least one white LED is used to increase a color rendering index, wherein the LED module is configured to allow a quantity of the first plurality of LEDs to be physically changed, wherein the first substantially similar constant monochromatic radiation emitted by the first plurality of LEDs, the second substantially similar constant monochromatic radiation emitted by the second plurality of LEDs, and the light emission of the at least one first white LED are reflected off a reflective inner surface of the luminaire housing before being emitted into the volume of space.

10. The luminaire according to claim 9, wherein the first total light emission spectrum of the luminaire is tunable by controlling at least one of the first sub-module and the second sub-module so that one or more spectral ranges is filtered out of the first total light emission spectrum of the luminaire, wherein filtering out the one or more spectral ranges influences a behavior of an animal species.

11. The luminaire according to claim 9, wherein the luminaire (2) is applied as a path luminaire or a road luminaire.

12. A method for influencing a light spectrum of a light source (13) in an ambient environment, wherein the method comprises:

controlling a first sub-module to emit a first substantially similar constant monochromatic radiation of a first non-white color and a second sub-module to emit a second substantially similar constant monochromatic radiation of a second non-white color so that the light source provides general illumination to a volume of space by emitting a first total light emission spectrum, wherein the first sub-module and the second sub-module are arranged on at least one LED carrier of an LED module (1), wherein the first sub-module comprises a first plurality of LEDs configured to emit a first substantially similar constant monochromatic among a first range of a first substantially similar constant monochromatic radiations of a first non-white color and at least one white LED to increase a color rendering index, wherein the second sub-module comprises a second plurality of LEDs configured to emit a second substantially similar constant monochromatic radiation among a second range of second substantially constant monochromatic radiations of a second non-white color, wherein the first sub-module is controlled independently of the second sub-module, wherein controlling the first sub-module comprises controlling the first plurality of LEDs together, wherein controlling the second sub-module comprises controlling the second plurality of LEDs together and independently of the first plurality of LEDs, wherein the first sub-module and the second sub-module are individually controlled simultaneously to emit the first total light emission spectrum, wherein the first total light emission spectrum is generated by overlapping the first substantially similar constant monochromatic radiation emitted by the first plurality of LEDs, a light emission emitted by the at least one first white LED, and the second substantially similar constant monochromatic radiation emitted by the second plurality of LEDs, wherein the first substantially similar constant monochromatic radiation, the second substantially similar constant monochromatic radiation, and the light emission overlap after each is directed toward and reflected off of a reflective inner surface of the luminaire before being emitted into the ambient environment, wherein the first substantially similar constant monochromatic radiation is within the first range, and wherein the second substantially similar constant monochromatic radiation is within the second range, wherein the LED module is configured to allow a quantity of the first plurality of LEDs to be physically changed.

13. The method according to claim 12, further comprising:

controlling the first plurality of LEDs on the first sub-module to emit a third substantially similar constant monochromatic radiation of the first non-white color so that the light source emits a second total light emission spectrum, wherein the third substantially similar constant monochromatic radiation is within the first range.

14. The method according to claim 13, further comprising:

controlling the second plurality of LEDs on the second sub-module to emit a fourth substantially similar constant monochromatic radiation of the second non-white color so that the light source emits a third total light emission spectrum, wherein the fourth substantially similar constant monochromatic radiation is within the second range.

15. The method according to claim 13, further comprising:

controlling the at least one white LED on the first sub-module independent of the first plurality of LEDs.

16. The method according to claim 12, wherein the first plurality of LEDs is arranged on the first sub-module along at least one of a row and a column.

17. The method according to claim 12, wherein controlling the first sub-module comprises changing a quantity of the first plurality of LEDs so that the first substantially similar constant monochromatic radiation of the first non-white color changes to another substantially similar constant monochromatic radiation of the first non-white color within the first range.

* * * * *